United States Patent [19]

Spanier

[11] Patent Number: 4,508,045

[45] Date of Patent: Apr. 2, 1985

[54] SAILBOARD HARNESS

[75] Inventor: Barry Spanier, Paia, Hi.

[73] Assignee: Maui Harness Corporation, Kahului, Hi.

[21] Appl. No.: 457,193

[22] Filed: Jan. 11, 1983

[51] Int. Cl.[3] ..... B63B 35/72; B63H 9/10

[52] U.S. Cl. ..... 114/39; 182/3; 182/7; 441/109

[58] Field of Search ..... 114/39, 248, 249, 39.2; 441/74, 73, 75, 110, 111, 115, 108, 109, 69; 182/3, 7

[56] References Cited

U.S. PATENT DOCUMENTS

| | | | |
|---|---|---|---|
| 725,206 | 4/1903 | Boisclaire | 182/7 |
| 3,494,319 | 2/1970 | Dunlap | 441/69 |
| 4,047,255 | 9/1977 | Kiefer | 114/39 |
| 4,140,205 | 2/1979 | Matson | 182/3 |
| 4,418,631 | 12/1983 | Frohbach | 114/39 |

FOREIGN PATENT DOCUMENTS

| | | | |
|---|---|---|---|
| 2649899 | 5/1978 | Fed. Rep. of Germany . | |
| 2747426 | 4/1979 | Fed. Rep. of Germany | 114/39 |
| 3008427 | 9/1980 | Fed. Rep. of Germany . | |
| 2916643 | 11/1980 | Fed. Rep. of Germany . | |
| 2324506 | 4/1977 | France . | |
| 2345172 | 10/1977 | France | 114/39 |
| 2457212 | 12/1980 | France . | |
| 2480703 | 10/1981 | France | 114/39 |
| 2515136 | 4/1983 | France | 114/39 |

OTHER PUBLICATIONS

*Surf Magazine* (HAI), Mar. 3, 1983.

*Primary Examiner*—Trygve M. Blix
*Assistant Examiner*—Patrick Young
*Attorney, Agent, or Firm*—Banner, Birch, McKie & Beckett

[57] ABSTRACT

A sailing harness adapted to be worn by a sailor and fastened to the sail assembly of a sailboard, for supporting the sailor during sailing and reducing fatigue. The harness includes a buttock-engaging member adapted to surround the sailor's buttocks, a coupling member connected to the buttock-engaging member at the front of the sailor, and adapted to be fastened to the sail assembly, and an elastic retaining member attached to the coupling member and adapted to be fastened to the upper torso of the sailor. The elastic retaining member keeps the coupling member close to the sailor's torso when no load is applied to the coupling member, and stretches to permit the coupling member to move away from the sailor's torso when load is applied during sailing. Substantially all of the load transmitted through the coupling member is therefore transferred to the sailor's hips.

12 Claims, 8 Drawing Figures

SAILBOARD HARNESS

BACKGROUND OF THE INVENTION

This invention relates to sailing harnesses and, more particularly, to a sailing harness for supporting a sailboard user during manipulation of the sail assembly while sailing.

Many different types of harnesses are known which can be worn by sailors of conventional sailing craft (i.e., those having fixed masts) to assist the sailor in "hiking out" to extend ballast through the use of a wire or rope. Harnesses of this type relieve strain that would nomally have to be taken by the sailor's arms and shoulders. Similar harnesses also are known for use with sailboards. However, because of the fundamental design and operational differences between sailboards and conventional sailboats, singificant discomfort often is experienced with such harnesses by the user of a sailboard. Specifically, present day sailboard harnesses attach above the lumbar vertebrae and work around the sailor's chest and shoulders, forcing the sailor to use the muscles of his lower back to straighten and extend his body to increase the ballast function, while manipulating the freely pivotable sail assembly through a boom or similar structure. This can result in severe lower back pain.

Other disadvantages also are inherent in present day sailboard harnesses. Without the use of a heavy, expensive spreader bar, these harnesses tend to compress the rib cage, making breathing difficult. The added weight of the speader bar increases fatigue. The hooks presently used with these harnesses permit fouling and twisting of the harness line. Perhaps most serious, a padded, full back harness can float a wearer face down, possibly causing death by drowning.

SUMMARY OF THE INVENTION

It is an object of the present invention to overcome the above-noted disadvantages of the prior art by providing a comfortable sailing harness for use with a sailboard which does not place undue stresses or strains on the sailor's body.

Another object of the invention is to provide a sailing harness which always will transmit the load to a specific desired portion of the sailor's body while permitting total freedom of movement of the arms and upper torso, essential for control of the sailboard.

Another object of the invention is to provide a sailing harness which will not twist or foul the harness line connected to the sail assembly.

Another object of the present invention is to provide a sailing harness which reduces the possibility of causing death by drowning.

These and other objects of the invention are accomplished by providing a sailing harness adapted to be worn by a sailor and fastened to the sail assembly of a sailboard, comprising buttock-engaging means, a coupling member and elastic retaining means. The buttock-engaging means is adapted to surround the sailor's buttocks and includes a projecting, flexible load-bearing portion which can extend upwardly and forwardly of the sailor's hips. The coupling member is connected to the load-bearing portion, and is adapted to be fastened to the sail assembly. The retaining means is attached to the coupling member and is adapted to be fastened to the upper torso of the sailor for keeping the coupling member close to the sailor's torso when no load is applied to the coupling member, and stretch to permit the coupling member to move away from the sailor's torso when load is applied to the coupling member without transmitting substantially any of the load to the sailor's upper torso. Hence, substantially all of the load transmitted through the coupling member is transferred through the buttock-engaging means to the sailor's hips.

The elastic nature of the retaining means allows the coupling member to be directly in line with the load direction. This places substantially no sailing load on the torso above the hips. Added flexibility and freedom of movement is provided by arranging the coupling member in a free floating manner relative to the buttock-engaging means. The coupling member itself is designed to prevent fouling or twisting of the harness line, and also can easily be slipped off the harness line when desired.

BRIEF DESCRIPTION OF THE DRAWINGS

The novel features of the invention are set out with particularlity in the appended claims, but the invention will be understood more fully and clearly from the following detailed description of a preferred embodiment of the invention taken in conjunction with the accompanying drawings, in which:

DETAILED DESCRIPTION OF A PREFERRED EMBODIMENT

Figure 1:
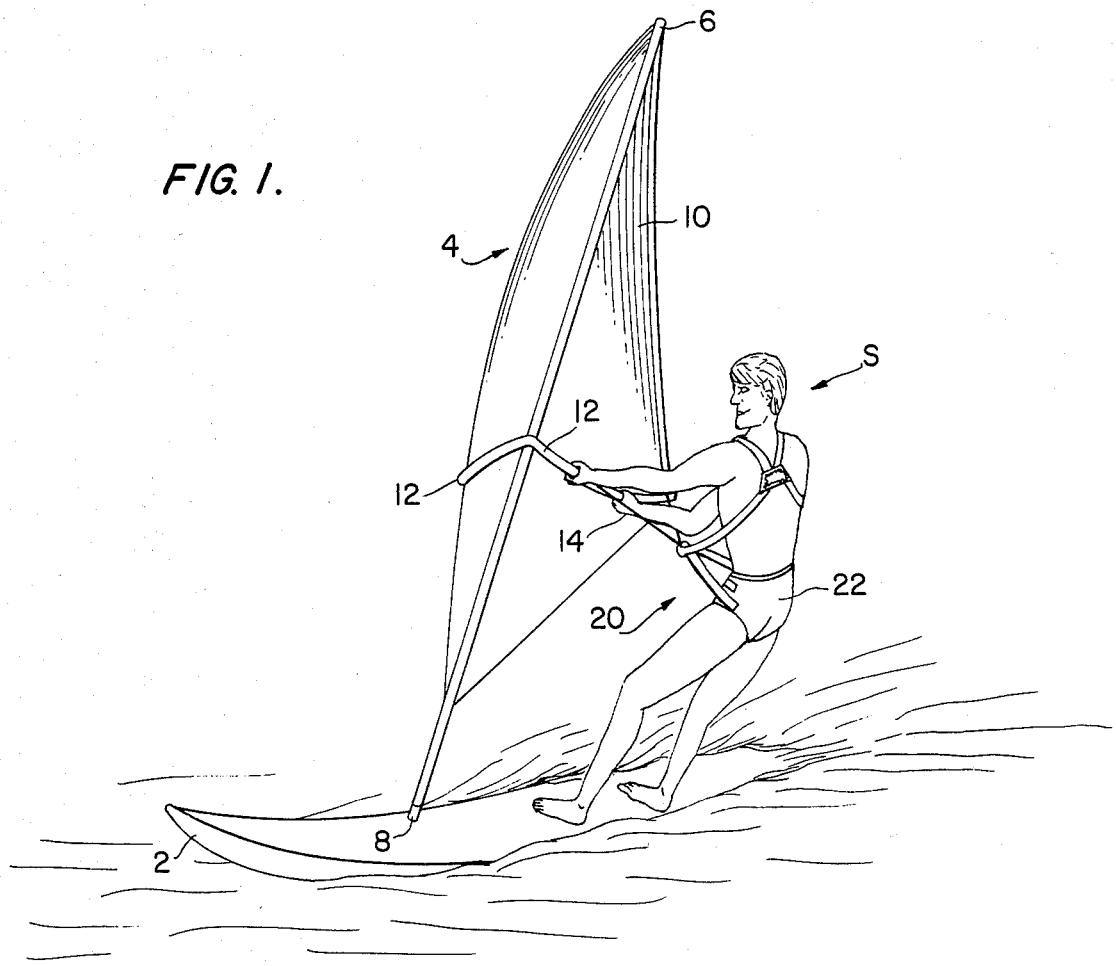
FIG. 1 is a perspective view of a sailing harness according to the invention being used by a sailor on a sailboard.

FIG. 1 illustrates a sailor S using the harness 20 of the invention while sailing a sailboard 2 having a sail assembly 4 including a mast 6 which is freely pivotable about board 2 at coupling 8. A sail 10 is supported by mast 6 and a pair of curved booms 12 which resemble a wishbone. A harness line 14 is fastened to one or both of the booms 12 and attaches to harness 20.

Figure 2:
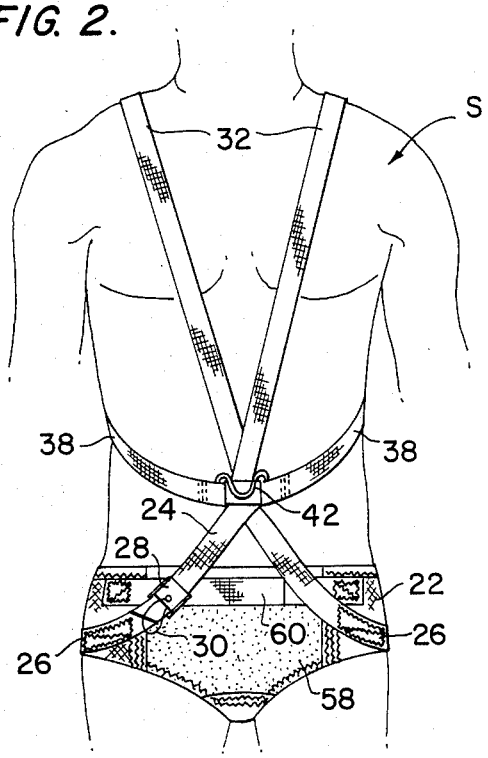
FIG. 2 is a front elevational view of the harness being worn by the sailor.
Figure 3:
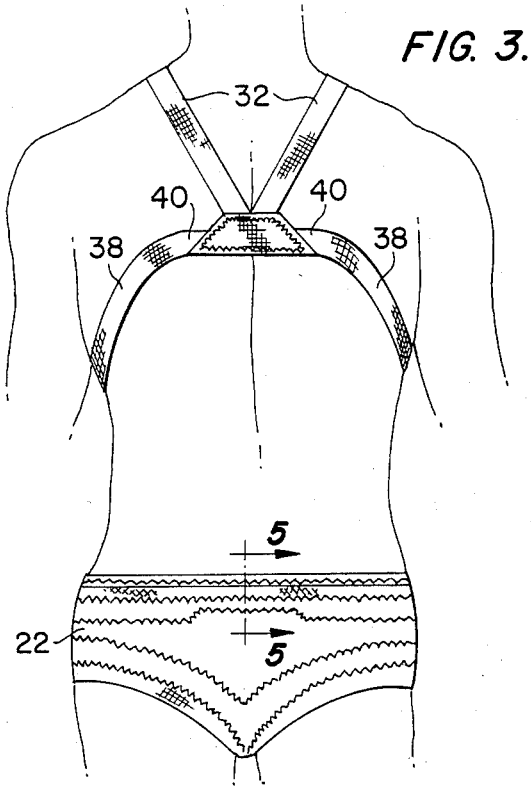
FIG. 3 is a rear elevational view of the harness.
Figure 4:
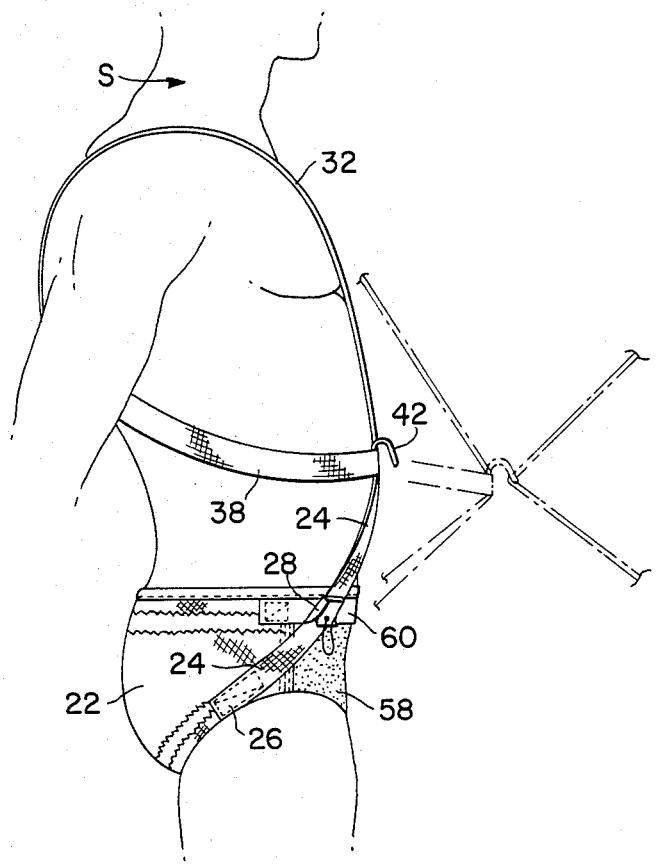
FIG. 4 is a side elevational view of the harness.
Figure 8:
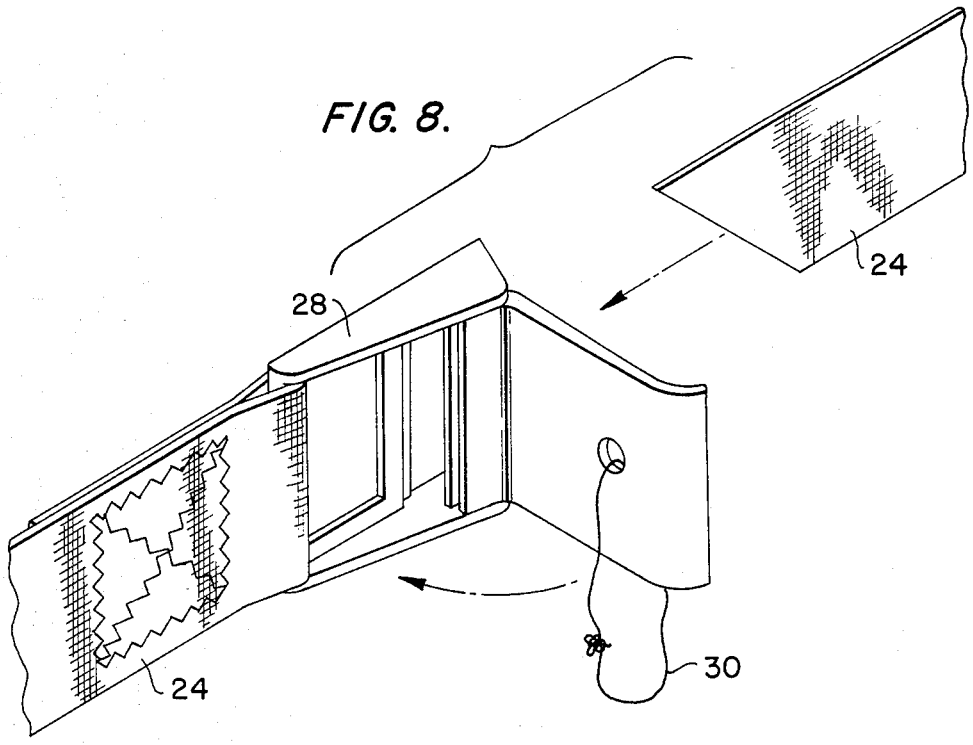
FIG. 8 is a perspective view showing the buckle on the load-bearing strap of the harness.

Referring to FIGS. 2, 3 and 4, harness 20 comprises a buttock-engaging member in the form of a brief 22 made of substantially inelastic material. An inelastic load-bearing strap 24 has its ends 26 fastened by stitching to the sides of brief 22, adjacent the sailor's hip joints. The working length of load-bearing strap 24 is adjustable by means of a buckle 28. A pull cord 30 (see FIG. 8) is provided for quick release of buckle 28.

Harness 24 further comprises an elastic retaining assembly including an elastic shoulder strap 32 which passes over both shoulders and has its ends 34 anchored by stitching to a fabric patch 36 located behind the sailor's back. The elastic retaining assembly also includes two torso straps 38, each of which has an end 40 secured by stitching to fabric patch 36 and extends around the side of the sailor's torso to the front.

Figure 6:
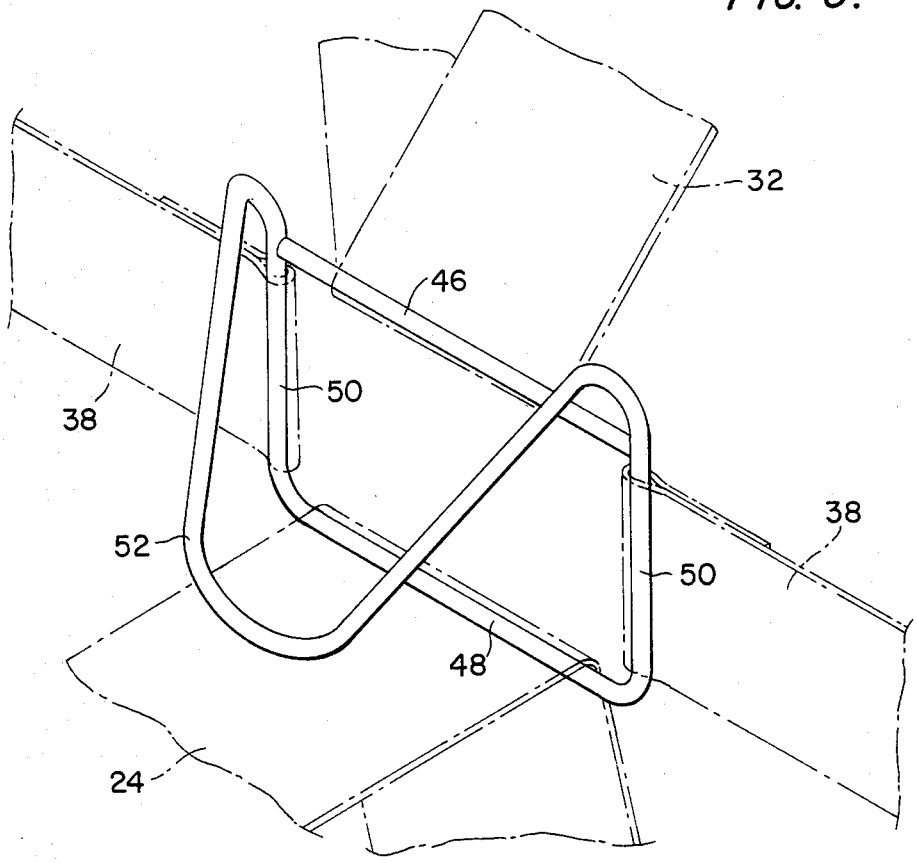
FIG. 6 is a perspective detail view of the coupling member of the harness.

All of the aforementioned straps and harness line 14 are attached at the front of the sailor to a coupling member 42. Referring to FIG. 6, coupling member 42 comprises a quadrilateral steel frame 44 of generally rectangular configuration. Frame 44 has generally parallel upper and lower legs 46, 48 which are joined to side legs 50. A downwardly and forwardly extending bail 52 is integrally connected to the upper portion of frame 44. Torso straps 38 are connected by stitching to side legs 50. Load bearing strap 24 passes around lower leg 48 and is slidable thereon. Similarly, shoulder strap 32 passes around upper leg 46 and is slidable thereon. Harness line 14 is adapted to pass around bail 52 and is slidable thereon. With this arrangement, as shown in FIG. 4, load applied to coupling member 42 by harness line 14 will stretch shoulder strap 32 and torso straps 38 while permitting coupling member 42 and load-bearing strap 24 to move forwardly and downwardly about the hip joints of the sailor. Because of the elasticity of shoulder strap 32 and torso straps 38, virtually no load is placed on the upper torso of the sailor, and substantially all of the load is placed directly on the hips in line with the load direction. This arrangement permits free movement of the upper body with no chest crushing or lower back pain. Flexibility is enhanced by the "free floating" nature of the coupling member 42 on shoulder strap 32 and load bearing strap 24, permitting the sailor to twist his body when desired without appreciably altering the hips. The design of bail 52 with its curved end and free floating connection to harness line 14 prevents twisting and fouling of the harness line.

Figure 5:
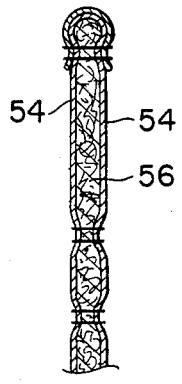
FIG. 5 is a partial sectional view of the harness taken along line 5—5 of FIG. 3.
Figure 7:
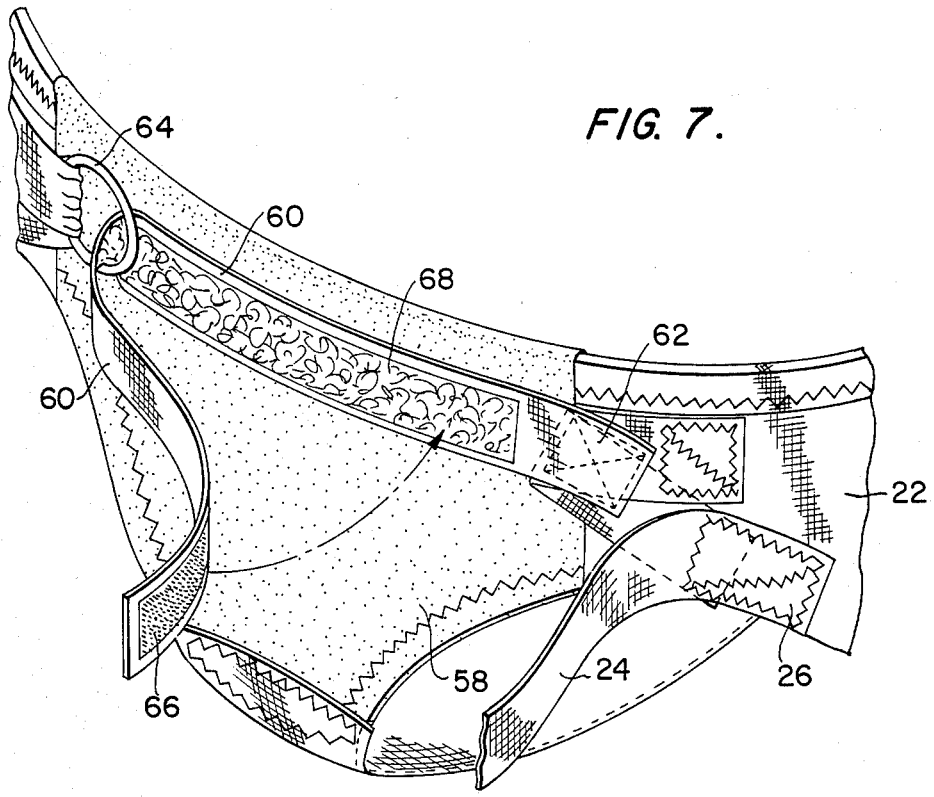
FIG. 7 is a perspective view of the front of the lower portion of the harness.

Referring to FIG. 5, brief 22 preferably is made of a heavy duty nylon shell 54, with all load areas padded with an internal closed-cell neoprene foam 56 for added comfort. The front of the brief 22 is provided with a stretchy neoprene panel 58 for groin comfort, and an adjustable waistband 60 (FIG. 7) keeps brief 22 snuggly in place while sailing. Waistband 60 is anchored by stitching at one end 62 adjacent one side of panel 58. A ring 64 is anchored adjacent the other side of panel 58. Waistband 60 passes through ring 64 and can be adjustably secured back upon itself by means of the mating elements 66, 68 of a separable fabric fastener, such as that manufactured and sold under the trademark VELCRO.

It will be apparent to one of ordinary skill in the art that numerous modifications and changes may be made in the structure of the sailing harness of the invention without departing from the true spirit and scope of the invention, which is defined by the appended claims. For example, a full brief 22, while preferred for maximum comfort, is not essential, as long as sufficient strapping or webbing is provided for supporting the buttocks and placing the load directly on the hips. Similarly, the specific elastic torso and shoulder strap arrangement illustrated and described, while preferred for comfort, is not essential, as long as sufficient elastic retention is provided for keeping the coupling member 42 up against the torso when no load is applied, and permitting movement of the coupling member away from the torso during sailing. Other modifications will be readily apparent to those skilled in the art.

I claim:

1. A sailing harness adapted to be worn by a sailor and fastened to the sail assembly of a sailboard for supporting the sailor during sailing and reducing fatigue, comprising:

buttock-engaging means adapted to surround the sailor's buttocks, including a projecting flexible load-bearing portion which is movable between an unloaded position close to the sailor's torso and a loaded position extending upwardly and forwardly of the sailor's hips;

a coupling member connected to said load-bearing portion and adapted to be fastened to the sail assembly, said coupling member movable between an unloaded position close to the sailor's torso and a loaded position forwardly of the sailor's hips; and elastic retaining means adapted to be fastened to the upper torso of the sailor for keeping said coupling member close to the sailor's torso when no load is applied to said coupling member, and stretching to permit said coupling member to move away from the sailor's torso when load is applied to said coupling member, without transmitting substantially any of said load to the sailor's upper torso, whereby substantially all of the load transmitted through said coupling member is transferred through said-buttock-engaging means to the sailor's hips.

2. A harness according to claim 1 wherein said load-bearing portion comprises a short, inelastic load-bearing strap anchored at its ends adjacent the sailor's hip joints and extending forwardly and upwardly away from the hip joints, with the intermediate portion of said load-bearing strap connected to said coupling member, whereby said coupling member and said load-bearing strap can pivot from a position adjacent the sailor's torso when no load is applied to said coupling member, downwardly and forwardly about the anchored ends of said load-bearing strap when load is applied to said coupling member.

3. A harness according to claim 2 wherein the length of said load-bearing strap is adjustable.

4. A harness according to claim 2 wherein said buttock-engaging means further comprises a brief, said load-bearing strap being anchored at its ends to the sides of said brief.

5. A harness according to claim 2 wherein said retaining means comprises an elastic retaining harness having an elastic shoulder strap which extends downwardly from both of the sailor's shoulders to said coupling member, and elastic torso straps which extend around the sides of the sailor's torso to said coupling member.

6. A harness according to claim 5 wherein said coupling member comprises a quadrilateral frame having generally upright side legs coupled to said upper and lower legs, and a forwardly projecting connector secured to said frame, said shoulder strap being attached to said upper leg, said load-bearing strap being slidably attached to said lower leg, said torso straps being attached to said side legs, and the said assembly adapted to be fastened to said connector.

7. A harness according to claim 6 wherein said shoulder strap is slidably attached to said upper leg.

8. A harness according to claim 7 wherein said connector is a bail which extends downwardly and forwardly from the top of said frame.

9. A harness according to claim 8 wherein said torso straps and the ends of said shoulder strap are fastened together behind the sailor's back.

10. A harness according to claim 6 further comprising a quick-release buckle in said load-bearing strap for quickly disengaging said load-bearing strap from said coupling member.

11. A harness according to claim 2 further comprising quick-release means for quickly disengaging said load-bearing strap from said coupling member.

12. A harness according to claim 1 further comprising quick-release means for quickly disengaging said load-bearing portion from said coupling member.

* * * * *